US005972134A

United States Patent [19]

Buschsieweke et al.

[11] Patent Number: 5,972,134

[45] Date of Patent: Oct. 26, 1999

[54] MANUFACTURE OF A METALLIC MOLDED STRUCTURAL PART

[75] Inventors: Otto Buschsieweke, Paderborn; Udo Klasfauseweh, Gütersloh; Günther Fortmeier, Ostenland, all of Germany

[73] Assignee: Benteler AG, Paderborn, Germany

[21] Appl. No.: 08/949,890

[22] Filed: Oct. 14, 1997

[30] Foreign Application Priority Data

Oct. 2, 1997 [DE] Germany ..... 197 43 802

[51] Int. Cl.[6] ..... C22C 38/38

[52] U.S. Cl. ..... 148/567; 148/639; 148/641; 148/643; 148/646

[58] Field of Search ..... 148/567, 639, 148/641, 643, 646

[56] References Cited

FOREIGN PATENT DOCUMENTS 03274231 12/1991 Japan .

08041534 2/1996 Japan .

09032935 2/1997 Japan .

*Primary Examiner*—Sikyin Ip

*Attorney, Agent, or Firm*—Friedrich Kueffner

[57] ABSTRACT

The invention is directed to a process for the manufacture of a metallic molded structural part (1) for motor vehicle components such as door impact girders or bumpers with areas (2) with a higher ductility in relation to the rest of the structural component part. For this purpose, partial areas (2) of a plate (5) are initially heated to a temperature of 900° C. within a period of less than 30 seconds. Subsequently, the thermal-treated plate (5') is shaped in a pressing tool (7) to form the molded structural part (1) and is heat-treated in the pressing tool (7).

5 Claims, 2 Drawing Sheets

MANUFACTURE OF A METALLIC MOLDED STRUCTURAL PART

BACKGROUND OF THE INVENTION

1. Field of the Invention

The invention is directed to a process for the manufacture of a metallic molded structural part for motor vehicle components which has areas with a higher ductility.

2. Description of the Related Art

Tool-heat-treated molded structural parts for motor vehicle components such as door impact girders or bumpers are manufactured with material characteristics which are distributed uniformly over the molded structural part. This is effected by means of a complete heat treatment of the molded structural parts. However, the ductility of the material decreases as a result of the high strength values achieved by the heat treatment with tensile strengths $R_m$ of approximately 1500 $N/mm^2$. The material accordingly loses its capacity to deform in a permanent manner. The breaking elongation $A_5$ is usually approximately 10%.

A varying plastic stiffness behavior of tool-heat-treated pressed molded structural parts is currently achieved by means of a partial rolling of the starting plates prior to shaping so that the thickness is reduced by area.

In different cases of application in automobile engineering, there is a need to provide areas with greater ductility in the molded structural parts. For this purpose, for example, closing plates, that is, inserts of softer steel quality, are integrated in the molded structural part. However, this procedure leads to a substantially more complicated manufacture and higher costs. Moreover, this adds appreciably to the weight of the molded structural part.

Also, the partial reduction in thickness using rolling technique to produce areas with different stiffness behavior entails high overhead and manufacturing costs. Further, depending on the configuration of the area to be rolled, the technological limits of processing by means of rolling techniques are restrictive. This is particularly true when rolling narrow regions.

SUMMARY OF THE INVENTION

Based on the prior art, the invention addresses the problem of simplifying the process of manufacturing metallic molded structural parts for motor vehicle components which have areas with a higher ductility so as to render manufacture more efficient and accordingly more economical, wherein the range of variation with respect to the geometrical configuration of the regions is increased.

Partial areas of the plate which are to have a higher strength than the rest of the structural part in the finished molded structural part are heated to a temperature between 600° C. and 900° C. within a period of less than 30 seconds. Following this, the thermal-treated plate is shaped in a pressing tool to form the molded structural part. The heat treatment is also carried out in the pressing tool.

The preferred temperature range is around 900° C., wherein the heating is carried out within a period of 20 to 25 seconds.

In accordance with a second solution to the problem with respect to the process, the prepared plate is initially preshaped or put into its final shape by means of compression molding and partial areas of the intermediate structural part or molded structural part are subsequently thermally treated in the above-mentioned manner. These areas have a substantially greater strength than the rest of the structural component part. The heat treatment can be carried out in the pressing tool with reduced shaping operations or even without any shaping operation. In some cases, only after-pressing (sizing) takes place. This process is preferably used for the manufacture of molded structural parts which should have broad, but short, ductile areas.

Finally, another solution to the problem according to the invention is preferably applied to the manufacture of molded structural parts with one or more narrow, long ductile areas.

According to the invention, a molded structural part is then initially shaped and heat-treated. For this purpose, the complete plate is heated homogeneously to a temperature between 900° C. and 950° C., shaped in a pressing tool to form a molded structural part, and subsequently heat-treated in a known manner. Following this, a deliberate partial increase in the ductility of the molded structural part is carried out in the desired areas through partial afterheating. In this way, a quick heating is carried out within the temperature limits and time limits in accordance with the invention.

In the process according to the invention, a plate is used which is made of a steel alloy with the following composition, expressed in percent by weight: carbon C between 0.18% and 0.3%, silicon Si between 0.1% and 0.7%, manganese Mn between 1.0% and 2.5%, phosphorous P of at most 0.025%, chromium Cr of 0.1% to 0.8%, molybdenum Mo between 0.1% and 0.5%, sulfur S of at most 0.01%, titanium Ti between 0.02% and 0.05%, boron B between 0.002% and 0.005%, and aluminum Al between 0.01% and 0.06%, wherein the remainder is iron, including impurities brought about as a result of smelting.

Further, the steel alloy can advantageously contain between 0.03% and 0.05% niobium Nb, although this is not compulsory. This prevents intercrystalline corrosion and increases thermal strength.

The partial afterheating is advisably carried out on the molded structural part which is fixed on a conveying device. In this way, it is possible to incorporate this process step in the manufacturing sequence in an efficient manner.

In principle, all suitable thermal treatment processes can be used for the partial heat treatment in accordance with the invention for increasing ductility. A particularly advantageous step consists in carrying out the thermal treatment by inductive methods.

The inductive process offers the possibility of concentrating the heating deliberately on one or more limited areas of a molded structural part. The heating is limited specifically to the zones whose ductility is to be increased. Also, virtually any configurations of the ductile zones can be achieved through suitable control or guidance of the inductor and/or of the molded structural part.

The partial inductive thermal treatment is economical and high yields can be achieved. The desired ductility characteristics can be produced through correct selection of the frequency of electrical output and the acting period. In this regard, the shortest heating times are possible through high power densities. These heating times should, in every case, be less than 30 seconds, preferably under 25 seconds, so as to eliminate unwanted influence on neighboring areas.

The core idea common to the above-mentioned solutions to the problem upon which the invention is based is to carry out an increase in ductility of partial areas of a molded structural part through a deliberate quick-heating adapted to the subsequent use of the molded structural part as a motor vehicle component. The heating can be carried out on the starting plate, on an intermediate molded structural part or also on the molded structural part which is already in its final shape, specifically before or after the actual heat treatment. The desired areas are heated to a temperature between 600° C. and 900° C. within a period of less than 30 seconds, advisably within a period between 10 seconds and 25 seconds.

Thus, a molded structural part of technically high quality can be economically produced, wherein the mechanical characteristic of high strength in one area and the mechanical characteristic of high ductility in another area advantageously complement one another in a synergistic manner.

The molded structural part has predominantly very high strength with low plastic deformation capacity or stiffness behavior and has one or more zones with low strength, but with high ductility.

A substantial advantage of the procedure proposed according to the invention consists in that a seamless and continuous transition is realized from the area of high strength to the ductile area and vice versa.

A steel alloy containing the following components in percent by weight has proven advisable as a starting material for the production of the molded structural parts: carbon C between 0.20% and 0.30%, silicon Si between 0.15% and 0.70%, manganese Mn between 1.0% and 2.5%, phosphorous P of at most 0.025%, chromium Cr of 0.10% to 0.80%, molybdenum Mo between 0.35% and 0.50%, sulfur S of at most 0.010%, titanium Ti between 0.03% and 0.05%, boron B between 0.002% and 0.005%, and aluminum Al between 0.02% and 0.06%, wherein the remainder is iron, including impurities brought about as a result of smelting. Niobium Nb between 0.03% and 0.05% can also be added to the alloy in this case.

In this steel alloy, the alloy components are adapted to one another in such a way that the very high requirements for the mechanical characteristics of a molded structural part with respect to tensile strength, yield strength and elongation at break are achieved. At the same time, this starting material allows an increase in ductility in determinable areas by partial heating and afterheating in the procedure suggested according to the invention. In this connection, a steel alloy having the above-described composition with the following proportions is also considered advantageous: carbon between 0.23% and 0.27%, silicon Si between 0.15% and 0.5%, manganese Mn between 1.10% and 1.40%, and chromium Cr between 0.15% and 0.35%.

The invention is described more fully hereinafter with reference to the embodiment examples shown in the drawings.

DESCRIPTION OF THE PREFERRED EMBODIMENTS

Figure 1:
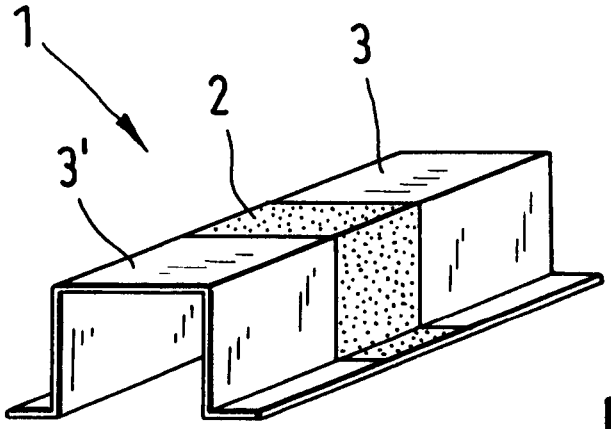
FIG. 1 shows a molded structural part with a broad, short ductile area.

FIG. 1 shows a technically simplified view of a molded structural part 1 for the production of motor vehicle components, for example, a door impact girder or bumper.

The molded structural part 1 has a broad, short area 2 in which the material of the molded structural part 1 has a substantially greater strength in comparison to the rest of the areas 3, 3' of the structural component part. Therefore, the areas 3, 3' impart a high ductility to the molded structural part 1, whereas area 2 imparts strength to the molded structural part 1.

Figure 2:
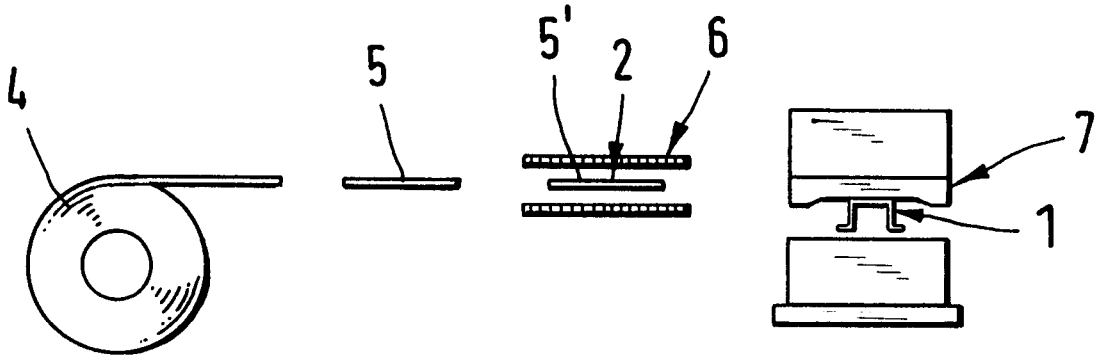
FIG. 2 shows a first manufacturing sequence of a molded structural part.

A manufacturing sequence for the production of the molded structural part 1 is described with reference to FIG. 2.

The starting material is taken off from a coil 4 in the form of strip and divided into plates 5 as required. A deliberate heating of partial areas 2 of the plate 5 through electromagnetic action is carried out by means of an inductor 6 as part of the installation. In this case, the areas 2 are deliberately heated to a temperature of 900° C. within a period of less than 25 seconds. The plate 5' which is thermally treated in this way is subsequently shaped in a pressing tool 7 to form a molded structural part 1. After the shaping, a heat treatment of the molded structural part 1 is carried out in the pressing tool 7.

A modification of the above-described manufacturing sequence with respect to the process consists in that the partial heating is carried out on a structural component part which is given its preliminary shape or final shape starting from the plate 5 by means of induction in the areas which should have higher strength characteristics. The heat treatment in the pressing tool 7 then takes place with reduced shaping operations in comparison to the procedure described above or with no shaping operations. If applicable, only sizing is carried out.

Figure 3:
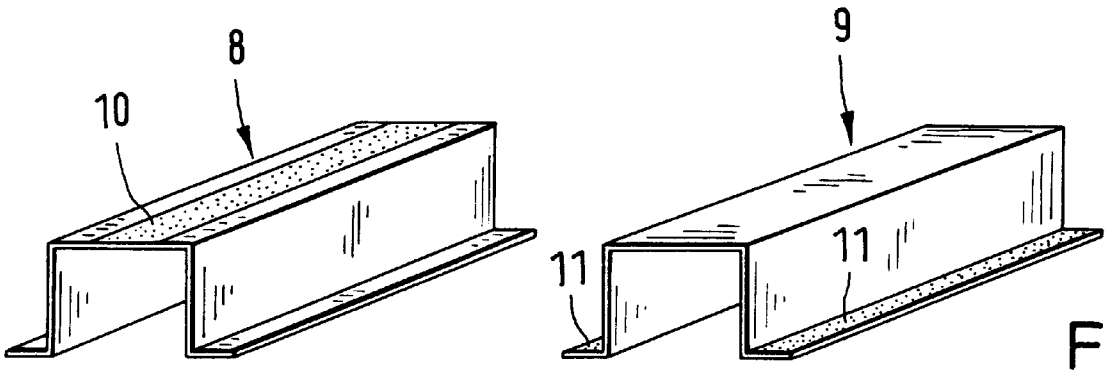
FIG. 3 shows two molded structural parts with narrow, long ductile areas.

FIG. 3 shows two molded structural parts 8, 9 with areas 10, 11 of higher ductility which are long and narrow and extend in the longitudinal direction of the molded structural parts 8, 9.

Figure 4:
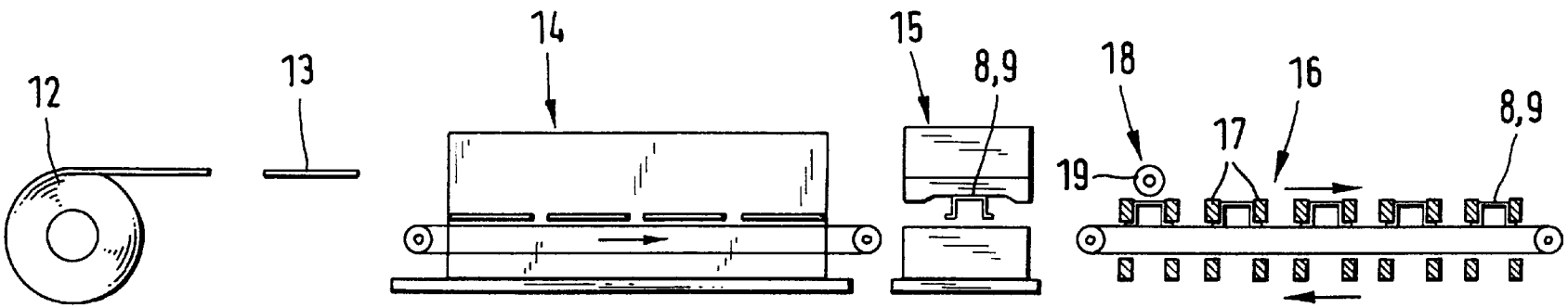
FIG. 4 shows a second manufacturing sequence of a molded structural part.

The manufacturing sequence of such molded structural parts 8, 9 with longitudinally emphasized ductile areas 10, 11 is described schematically with reference to FIG. 4.

The starting material is taken off from a coil 12 and divided into plates 13 according to requirements. Subsequently, the plates 13 are homogeneously heated to a temperature between 900° C. and 950° C. As is shown, this is effected in a continuous furnace 14. However, this thermal pretreatment can also be carried out in another way, for example, by inductive heating. In this case, the entire plate 13 is heated to the temperature. After this thermal pretreatment, a plate 13 is given its final shape in the pressing tool 15 to form the molded structural part 8, 9. Required heat treatment processes also take place in the pressing tool.

Following this, the molded structural parts 8, 9 are picked up and oriented in position on a conveyor 16 by fasteners 17. On the conveyor 16, the molded structural parts 8, 9 pass through a heating device 18 in which those areas 10, 11 which should have a higher ductility are heated to a temperature of approximately 600° C. to 800° C. within a very short time by means of an inductor 19. Subsequently, the areas 10, 11 heated in this way are slowly cooled.

We claim:

1. Process for the manufacture of a metallic molded structural part for motor vehicle components which has areas with a higher ductility, in which a plate (5) is prepared from a steel alloy comprising, in percent by weight, carbon (C) 0.18% to 0.3%, silicon (Si) 0.1% to 0.7%, manganese (Mn) 1.0% to 2.50%, phosphorous (P) at most 0.025%, chromium (Cr) 0.1% to 0.8%, molybdenum (Mo) 0.1% to 0.5%, sulfur (S) at most 0.01%, titanium (Ti) 0.02% to 0.05%, boron (B) 0.002% to 0.005%, aluminum (Al) 0.01% to 0.06%, wherein the remainder is iron, including impurities brought about as a result of smelting, wherein partial areas (2) of the plate (5) are initially heated to a temperature between 600° C. and 900° C. in a period of less than 30 seconds, whereupon the thermal-treated plate (5') is shaped in a pressing tool (7) to form the molded structural part (1), and the molded structural part (1) is then heat-treated in the pressing tool (7).

2. Process for the manufacture of a metallic molded structural part for motor vehicle components which has areas with a higher ductility, in which a plate (5) is prepared from a steel alloy comprising, in percent by weight, carbon (C) 0.18% to 0.3%, silicon (Si) 0.1% to 0.7%, manganese (Mn) 1.0% to 2.50%, phosphorous (P) at most 0.025%, chromium (Cr) 0.1% to 0.8%, molybdenum (Mo) 0.1% to 0.5%, sulfur (S) at most 0.01%, titanium (Ti) 0.02% to 0.05%, boron (B) 0.002% to 0.005%, aluminum (Al) 0.01% to 0.06%, wherein the remainder is iron, including impurities brought about as a result of smelting, wherein the plate is initially pre-shaped or put into its final shape by means of compression molding to form an intermediate structural part or molded structural part and partial areas of the intermediate structural part or molded structural part are subsequently heated to a temperature between 600° C. and 900° C. within a period of less than 30 seconds, whereupon the thermal-treated intermediate structural part or molded structural part plate is after-shaped and/or heat-treated in a pressing tool (7).

3. Process for the manufacture of a metallic molded structural part for motor vehicle components which has areas with a higher ductility, in which a plate (13) is prepared from a steel alloy comprising, in percent by weight, carbon (C) 0.18% to 0.3%, silicon (Si) 0.1% to 0.7%, manganese (Mn) 1.0% to 2.50%, phosphorous (P) at most 0.025%, chromium (Cr) 0.1% to 0.8%, molybdenum (Mo) 0.1% to 0.5%, sulfur (S) at most 0.01%, titanium (Ti) 0.02% to 0.05%, boron (B) 0.002% to 0.005%, aluminum (Al) 0.01% to 0.06%, wherein the remainder is iron, including impurities brought about as a result of smelting, wherein the plate is initially homogeneously heated to a temperature between 900° C. and 950° C., whereupon the plate (13) is shaped in a pressing tool (15) to form the molded structural part (8, 9), and the molded structural part (8, 9) is then heat-treated in the pressing tool (15), and that partial areas (10, 11) of the molded structural part (8, 9) are subsequently heated to a temperature between 600° C. and 900° C. within a period of less than 30 seconds.

4. Process according to claim 3, wherein the partial thermal treatment is carried out on the molded structural part (8, 9) which is fixed on a conveyor device (16).

5. Process according to one of claims 1 to 4, wherein the partial thermal treatment is carried out by inductive heating.

* * * * *